US007143817B2

(12) United States Patent
Li

(10) Patent No.: US 7,143,817 B2
(45) Date of Patent: Dec. 5, 2006

(54) SUPPORT STRUCTURE OF HEAT-PIPE MULTI-LAYER WICK STRUCTURE

(76) Inventor: Jia-Hao Li, No. 2, Lane 127, Dang Ke St., Kang Shan Jen, Kao Hsiung Hsien (TW)

( * ) Notice: Subject to any disclaimer, the term of this patent is extended or adjusted under 35 U.S.C. 154(b) by 0 days.

(21) Appl. No.: 11/022,668

(22) Filed: Dec. 28, 2004

(65) Prior Publication Data

US 2006/0137858 A1 Jun. 29, 2006

(51) Int. Cl.
*F28D 15/04* (2006.01)

(52) U.S. Cl. ..... 165/104.26; 165/104.33

(58) Field of Classification Search ..... 165/104.33, 165/104.26, 185, 80.4; 361/704, 697, 700; 29/890.032
See application file for complete search history.

(56) References Cited

U.S. PATENT DOCUMENTS 3,681,843 A * 8/1972 Arcella et al. ..... 29/423
3,921,710 A * 11/1975 Katayama ..... 165/104.26
5,076,352 A * 12/1991 Rosenfeld et al. ..... 165/104.26
6,427,765 B1 * 8/2002 Han et al. ..... 165/104.26
6,460,612 B1 * 10/2002 Sehmbey et al. ..... 165/96
6,619,384 B1 * 9/2003 Moon et al. ..... 165/104.26
2001/0004934 A1 * 6/2001 Yamamoto et al. .... 165/104.11
2004/0112450 A1 * 6/2004 Hsu ..... 138/38
2005/0145368 A1 * 7/2005 Hsu ..... 165/104.11

FOREIGN PATENT DOCUMENTS

JP 60-259401 * 12/1985 ..... 165/104.26

* cited by examiner

*Primary Examiner*—Teresa J. Walberg

(57) ABSTRACT

A support structure of a heat-pipe multi-layer wick structure, having a hollow heat-pipe tube and multiple separate layers of weaving mesh wick structure overlaying on an interior surface of the heat-pipe tube. The wick structure has a curly circular shape. The outermost layer of the wick structure has lower melting point compared to the inner layers of thereof. Thereby, the capillary force of the heat pipe is enhanced, while the mesh at the inner layers with higher melting point provides better support to the outer layers of the wick structure.

7 Claims, 5 Drawing Sheets

SUPPORT STRUCTURE OF HEAT-PIPE MULTI-LAYER WICK STRUCTURE

BACKGROUND OF THE INVENTION

The present invention relates in general to a support structure of a heat-pipe multi-layer wick structure, and more particularly, to a support structure allowing the multi-layer wick structure thoroughly attached to an interior surface of a heat pipe.

The heat pipe has been applied in various types of electronic products for delivering large amount of heat without consuming significant power because of the characteristics of high thermal transmission capacity, high thermal transmission speed, high thermal conduction efficiency, light weight, none mobile element, simple structure and versatile applications. The conventional heat pipe includes a wick structure attached to an interior surface of a heat-pipe body. The wick structure includes weaving mesh that has capillary effect, such that a working fluid filled in the heat-pipe body can be used to deliver heat. To improve the capillary force and the amount of heat to be transferred by the wick structure, multi-layer structure has been adapted in the heat pipe.

FIG. 1 shows a conventional weaving mesh of a wick structure 1*a* which is curled into a multi-layer structure. When the curled wick structure 1*a* is inserted into the heat pipe body 2*a*, a sintering process is required to attach the curled wick structure 1*a* to the internal surface of the heat pipe body 2*a*. However, as the weaving mesh of the wick structure 1*a* is typically too soft to support itself. The multi-layer portion A formed by curling process makes the attachment worse. As there provides no additional support structure, the wick structure 1*a* is easily softened and collapsed due to the heat generated in the high-temperature sintering process.

BRIEF SUMMARY OF THE INVENTION

To resolve the above drawbacks, a support structure of a multi-layer wick structure of a heat pipe is provided. By shrinking the tubular member of the heat pipe, the weaving meshes of each layer of the wick structure can be attached to an interior surface of the tubular member. Further, the lower-melting-point portion of the wick structure is arranged as the outermost layer to provide enhanced capillary force of the working fluid, while the higher-melting-point portion of the wick structure is arranged in the inner layers to provide better attaching effect to the interior surface of the tubular member.

Accordingly, the support structure of the multi-layer wick structure of a heat pipe includes a hollow heat-pipe tube and multiple separate layers of weaving mesh wick structure overlaying on an interior surface of the heat-pipe tube. The wick structure has a curly circular shape. The outermost layer of the wick structure has lower melting point compared to the inner layers of thereof. Thereby, the capillary force of the heat pipe is enhanced, while the mesh at the inner layers with higher melting point provides better support to the outer layers of the wick structure.

The objectives of the present invention will become obvious to those of ordinary skill in the art after reading the following detailed description of preferred embodiments.

It is to be understood that both the foregoing general description and the following detailed description are exemplary, and are intended to provide further explanation of the invention as claimed.

BRIEF DESCRIPTION OF THE DRAWINGS

The above objects and advantages of the present invention will be become more apparent by describing in detail exemplary embodiments thereof with reference to the attached drawings in which.

DETAILED DESCRIPTION OF THE INVENTION

Figure 1:
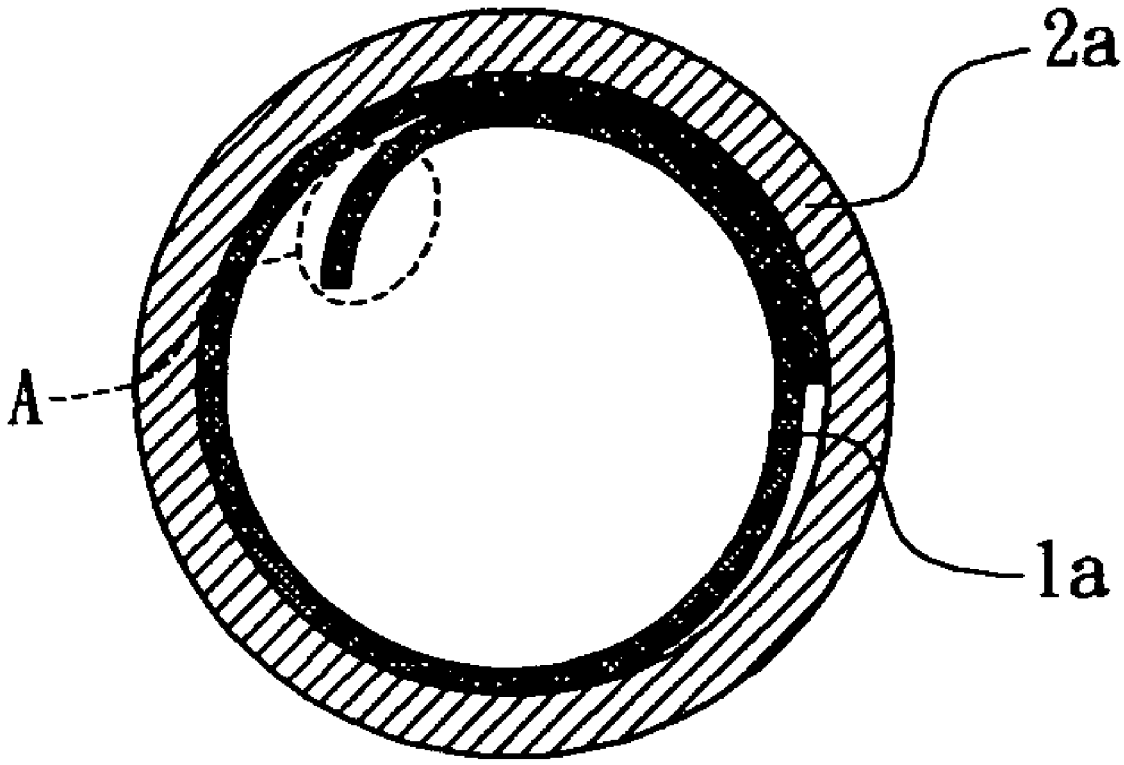
FIG. 1 PRIOR ART
FIG. 1 shows an a cross sectional view of a conventional heat pipe.

Reference will now be made in detail to the preferred embodiments of the present invention, examples of which are illustrated in the accompanying drawings. Wherever possible, the same reference numbers are used in the drawings and the description to refer to the same or like parts.

Referring to FIGS. 2–6, a support structure of a multi-layer wick structure of a heat pipe is provided. The wick structure is attached to the interior surface of a tubular member by a shrinking process performed to the tubular member.

Figure 2:
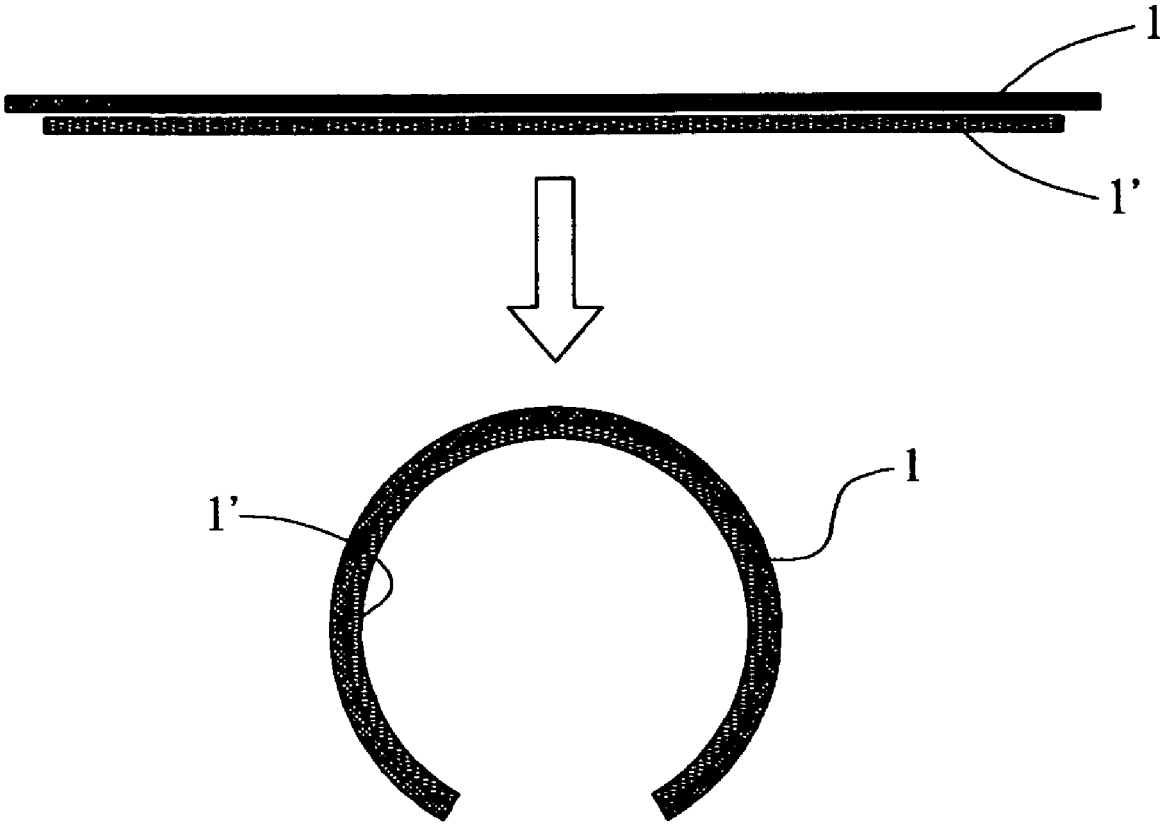
FIG. 2 shows the process of winding a multi-layer wick structure.
Figure 3:
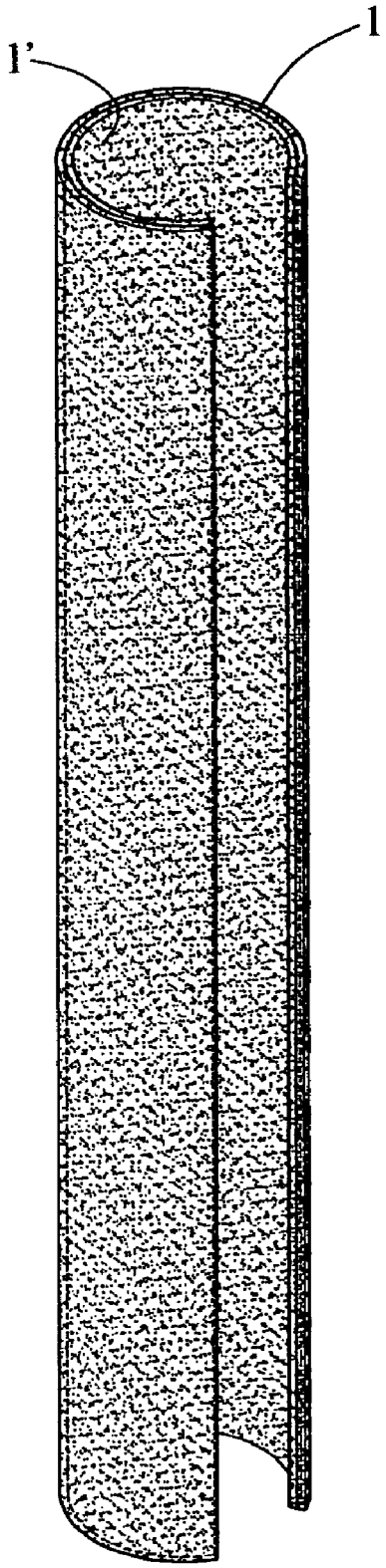
FIG. 3 shows the open circular profile of the winded multi-layer wick structure.

As shown in FIGS. 2 and 3, the wick structure has an outer layer and an inner layer of weaving meshes 1 and 1' overlaying each other. As shown in FIGS. 2 and 3, the wick structure is winded into an open circle with the layer of weaving mesh 1 encircling the layer of weaving mesh 1'. Therefore, the outer layer 1 is preferably longer than the inner layer 1'.

Figure 4:
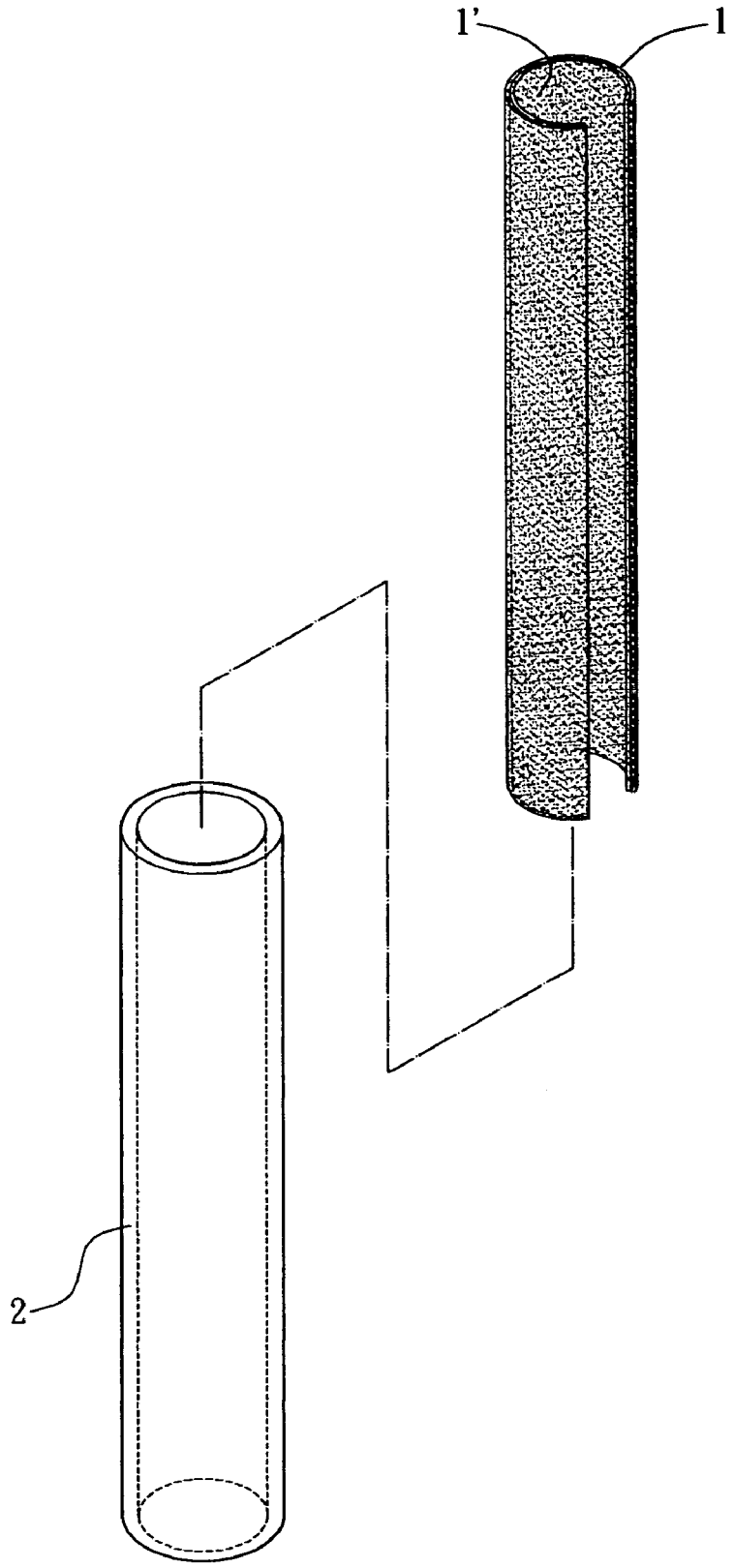
FIG. 4 shows the process for inserting the wick structure into a tubular member of a heat pipe.
Figure 5:
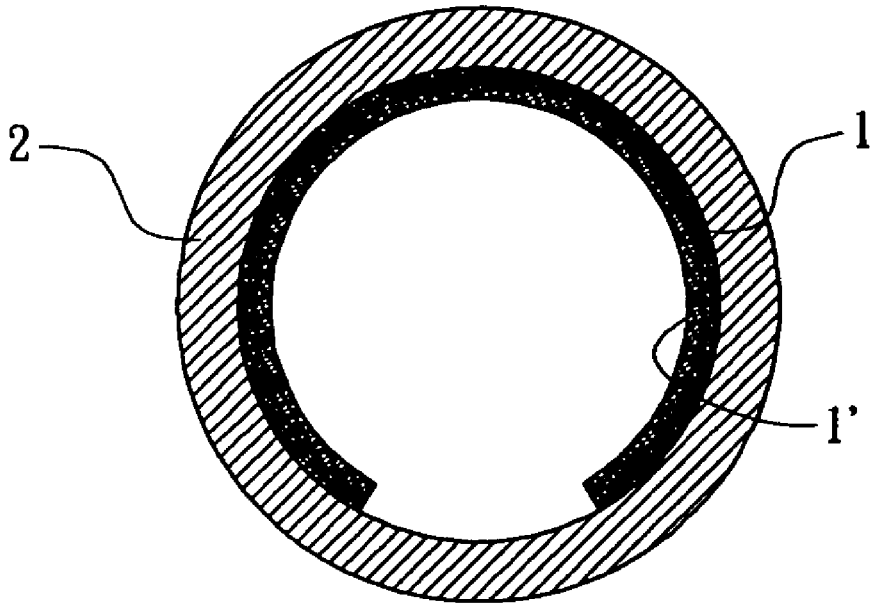
FIG. 5 shows the cross sectional view of the heat pipe before the tubular member is shrunk.

As shown in FIG. 4, a tubular member 2 is provided. Preferably, the tubular member 2 has an internal diameter no less than the exterior diameter of the open circle formed of the layers of weaving meshes 1 and 1', such that the layers of weaving meshes 1 and 1' can be easily inserted into the tubular member 2. A cross sectional view of the tubular member 2 and the wick structure formed of the winded layers of weaving meshes 1 and 1' is shown in FIG. 5.

Figure 6:
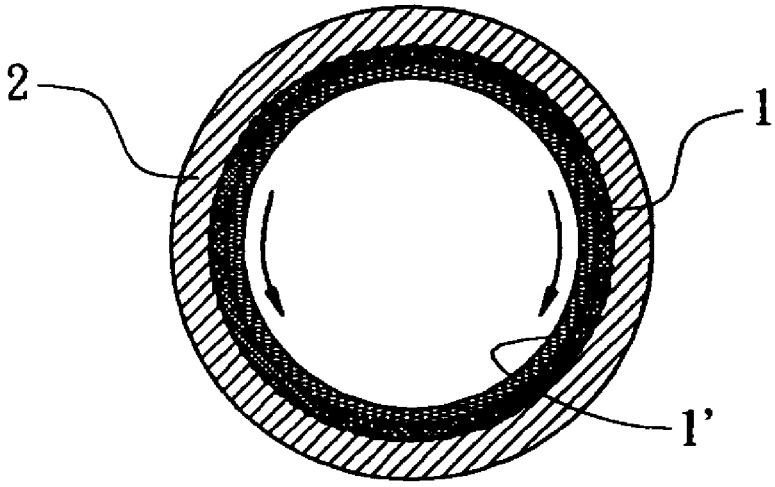
FIG. 6 shows the cross sectional view of the end-product of the heat pipe.

In FIG. 6, a shrinking process is performed to the tubular member 2. As shown, an external force is applied to press the tubular member 2 inwardly. Thereby, the diameter of the tubular member 2 is reduced, and the open circle made by the layers of weaving meshes 1 and 1' is closed and firmly attached to the interior surface of the tubular member as shown. Thereby, a sintering process is not required for attaching the wick structure to the tubular member 2, such that the wick structure will not be peeled from the tubular member in the subsequent annealing process.

Preferably, the inner layer 1' of the wick structure has a weaving mesh with a melting point higher than that of the outer layer 1. For example, the inner layer 1' of the wick structure can be made of bronze, and the outer layer 1 of the wick structure can be made of oxygen-free copper. Moreover, the higher-melting-point inner layer 1' can have the melting point higher than the temperature of the annealing process, and the lower-melting-point outer layer 1 can have the melting point lower than the temperature of the annealing process. Therefore, during the high-temperature annealing process, the higher-melting-point weaving mesh of the inner layer 1' can provides sufficient support to the lower-melting-point weaving mesh of the outer layer 1 when the outer layer 1 starts melting at the operation temperature higher than its melting point, such that the lower-melting-point weaving mesh of the outer layer 1 is not easily softened and peeled from the interior surface of the tubular member 2.

By the above process, the wick structure does not need to be curled into a close circle before being inserted into the tubular member 2. The insertion is thus easier. By the shrinking process of the tubular member 2, the wick structure can be easily attached to the interior surface thereof. Further, as the outer layer 1 has a lower-melting-point mesh compared to that of the inner layer 1', the capillary force of the heat pipe is enhanced, while the higher-melting-point mesh at the inner layers 1' provides better support to the outer layers of the wick structure.

While the present invention has been particularly shown and described with reference to preferred embodiments thereof, it will be understood by those of ordinary skill in the art the various changes in form and details may be made therein without departing from the spirit and scope of the present invention as defined by the appended claims.

What is claimed is:

1. A support structure of a multi-layer wick structure attached to a tubular member of a heat pipe, comprising:

a first weaving mesh attached to an interior surface of the tubular member; and a second weaving mesh encircled by the first weaving mesh, wherein the first weaving mesh has a melting point lower than that of the second weaving mesh.

2. The structure of claim 1, wherein the first weaving mesh has a melting point lower than an operation temperature of an annealing process, and the second weaving mesh has a melting point higher than the operation temperature.

3. The structure of claim 1, wherein the first weaving mesh is made of bronze, and the second weaving mesh is made of oxygen-free copper.

4. A heat pipe, comprising:

a tubular member; and a wick structure, comprising multiple layers of weaving meshes, wherein an outermost weaving mesh of the wick structure is directly attached to an interior surface of the tubular member, and the outermost weaving mesh has a melting point lower than the other weaving meshes.

5. The heat pipe of claim 4, further comprising a working fluid filled in the tubular member.

6. The heat pipe of claim 4, wherein the outermost weaving mesh has a melting point lower than an operation temperature of an annealing process, and the other weaving meshes have a melting point higher than the operation temperature.

7. A support structure of a multi-layer wick structure attached to a tubular member fabricated by the steps of:

overlying a first weaving mesh and a second weaving mesh, wherein the first weaving mesh has a melting point lower than the second weaving mesh;

winding the first and the second weaving meshes into an open circular wick structure with the first weaving mesh encircling the second weaving mesh;

inserting the open circular wick structure into a tubular member;

shrinking the tubular member to press the open circular wick structure into a close circular wick structure; and melting the first weaving mesh to firmly attach on an interior surface of the tubular member by an annealing process.

* * * * *